United States Patent [19]

Braun et al.

[11] 4,323,282

[45] Apr. 6, 1982

[54] CONVEYING TROUGH WITH MINING MACHINE CUTTER GUIDE SURFACES

[75] Inventors: Ernst Braun; Gert Braun, both of Essen-Heisingen, Fed. Rep. of Germany

[73] Assignee: Halbach & Braun, Fed. Rep. of Germany

[21] Appl. No.: 168,330

[22] Filed: Jul. 11, 1980

[30] Foreign Application Priority Data

Jul. 11, 1980 [DE] Fed. Rep. of Germany ..... 2927962

[51] Int. Cl.[3] ..... E21C 35/08

[52] U.S. Cl. ..... 299/43; 299/34

[58] Field of Search ..... 299/32, 34, 43–46

[56] References Cited

U.S. PATENT DOCUMENTS 4,067,620 1/1978 Lanfermann ..... 299/43
4,235,475 11/1980 Monks ..... 299/43

FOREIGN PATENT DOCUMENTS 1109605 4/1968 United Kingdom ..... 299/43
1335384 10/1973 United Kingdom ..... 299/43
258211 4/1970 U.S.S.R. ..... 299/43

*Primary Examiner*—Ernest R. Purser

*Attorney, Agent, or Firm*—McGlew and Tuttle

[57] ABSTRACT

A conveying trough for use in a coal mining seam which has a coal winning sidewall with a waste sidewall, disposed opposite to the coal winning sidewall, which comprises, a guide plate adapted to be secured to the waste sidewall and a base frame adapted to be adjacent the winning sidewall. A gantry-like cutter spans the space between the waste side wall and the winning sidewall and has one side with a track wheel with a running surface associated with the guide plate. An angle bar has a first substantially horizontal fixing leg portion secured to the base frame and also has an upright guide leg portion affixed to the fixing leg portion. The tracking bar is carried by the cutter and has an edge in cooperative engagement with the guide leg portion. The tracking bar and the guide leg portions have substantially vertical slide surfaces which cooperatively interengage during the running of the cutter. The construction also advantageously includes a hold-down member associated with the track wheel which has a running surface which engages beneath a running surface of a guide rail carried at the baseplate side. In addition, the tracking bar includes a horizontally extending portion which engages beneath a guide surface of a member supported on the base frame.

9 Claims, 5 Drawing Figures

CONVEYING TROUGH WITH MINING MACHINE CUTTER GUIDE SURFACES

FIELD AND BACKGROUND OF THE INVENTION

This invention relates to conveyors in general and, in particular, to a new and useful conveying trough comprising a guide plate secured to the coal face sidewall of the trough, and a base frame secured to the waste sidewall of the trough, with the guide plate being associated with a running surface for the track wheel of a cutter or another winning machine bridging the trough in a gantry-like manner, and with the base frame being equipped for moving the cutter therealong.

Conveying troughs of this kind in which the base frame is equipped with a chain guide for moving the cutter are known. For this purpose, a chain extending in the working direction is run in the base frame, and one or more sprocket wheels provided on the cutter, engage the chain. Such chain guides have proven to be satisfactory. However, during operation of the cutter, as a rule, the sprocket wheels are exposed to extreme loads resulting from the occurring transverse forces and tilting moments, and the present invention is directed to remedial measures therefor.

SUMMARY OF THE INVENTION

The present invention is directed to a conveying trough for use in a coal mining seam which provides a stable guidance of the cutter and relieves the sprocket wheels from loads.

To this end, the invention provides that an angle bar which has a fixing leg and an upright guide leg is provided on the base frame of the conveyor and the cutter is equipped with a tracking bar which cooperates with the guide leg for relative movement in a horizontal plane, wherefore, the guide leg and the tracking bar are provided with vertical side surfaces associated with each other. Due to these inventive features, the cutter is satisfactorily guided in its horizontal motion, so that the transverse forces are neutralized and a removal of load from the sprocket wheels is ensured. In fact, due to the tracking bar operating on the guide leg of the inventive conveying trough, the cutter is horizontally braced. In any event, the horizontal clearance of motion of the cutter is substantially reduced, with the result of a sprocket wheel relief.

Further substantial features of the invention may be pointed out as follows: Advantageously, the fixed leg of the angle bar is screwed to the base frame and the guide leg of the bar is supported on the top of the trough wall. This makes it possible to easily exchange the angle bar and, at the same time, the transverse forces are securely taken up. It may further be provided that in the transition zone between the fixing leg and the guide leg, the angle bar is provided with apertures at locations which are spaced from each other by predetermined distances. An accumulation of coal fines at these locations and, consequently, soiling of the slide surfaces, is thereby prevented. The coal fines can thus fall through the apertures.

In a particularly important development of the invention, the tracking bar is designed as a hold-down member and is formed with a projecting tracking leg on its side remote from the guide leg which engages, from beneath, a guide bar secured to the base frame. In this way, the cutter is, at the same time, secured against lifting.

Another feature of the invention is that slide surfaces are provided on the top side of the tracking leg and on the underside of the guide bar. This ensures very satisfactory conditions of guidance and motion. To make certain that the cutter is also braced in the waste side direction, the invention provides that the insides associated with each other of the tracking bar at the guide bar are designed as slide surfaces. In consequence, the clearance of motion of the cutter in the horizontal direction is reduced to the space formed between the guide bar and the guide leg of the angle bar.

With thin coal seams, the running surface associated with the guide plate will be provided near the floor. For thick seams, a particular development of the invention provides that the guide plate supports a guide rail which is secured thereto and formed with a guide claw projecting to the inside of the trough, with the top side of the guide claw forming a running surface for the track wheel of the cutter, and the underside of the guide claw being engaged from beneath by a hold-down member which is secured to the cutter and has a corresponding claw-like leg. Due to this provision, the running surface for the track wheel is located relatively high above the floor and does not become dirty, and the cutter is prevented from tilting by the guide claw of the guide rail and the claw-like leg of the hold-down member engaging it from below, so that the sprocket wheels are relieved from tilting moments.

In order to prevent a locked-up run, the invention provides that the guide claw and the claw-like leg have slide surfaces which are inclined relative to the horizontal plane. Further, the vertical transition zone adjacent the joint between the guide plate and the guide rail, as well as the associated vertical portion of the claw-like leg, are designed as slide surfaces. A horizontal bracing of the cutter in this zone is thereby obtained, which relieves the sprocket wheels from transverse loads. At the same time, the dimensions relative to the guide leg of the angle bar on the base frame are such that the vertical slide surfaces of both the tracking bar and the guide claw apply against the associated slide surfaces of the guide leg and the guide rail, respectively. All of the slide surfaces are advantageously formed by plating with a wear-resistant material.

The advantage obtained with the invention is that a conveying trough of the above-mentioned design, having a guide plate and a base frame, is equipped with a guide rail and an angle bar in such a manner that the tilting moments and transverse forces exerted on the cutter, while it is guided on the trough, are quite satisfactorily absorbed. As a result, the sprocket wheels for moving the cutter along a chain guide are considerably relieved of loads caused by tilting moments and transverse forces. At the same time, the clearance of passage is substantially enlarged. In general, the guidance of the cutter itself is also stabilized in a simple way, thus improving its operation.

Accordingly, an object of the present invention is to provide a conveying trough for use in a coal mining seam, having a coal winning sidewall and a waste sidewall opposite to the winning sidewall and which includes a guide plate adapted to be secured to the waste sidewall and a base frame adapted to be located adjacent the winning sidewall for carrying a gantry-like cutter thereover which has one side with a track wheel with a running surface associated with the guide plate and has an angle bar on the base frame side with a horizontal portion fixed to the baseplate and with an upright portion forming a guide surface which cooperates with a tracking bar carried by the cutter with the guide surfaces of the tracking bar and the guide leg portion being substantially vertical slide surfaces.

A further object of the invention is to provide a conveying trough for use in a coal mining seam, which is simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENT

Figure 1:
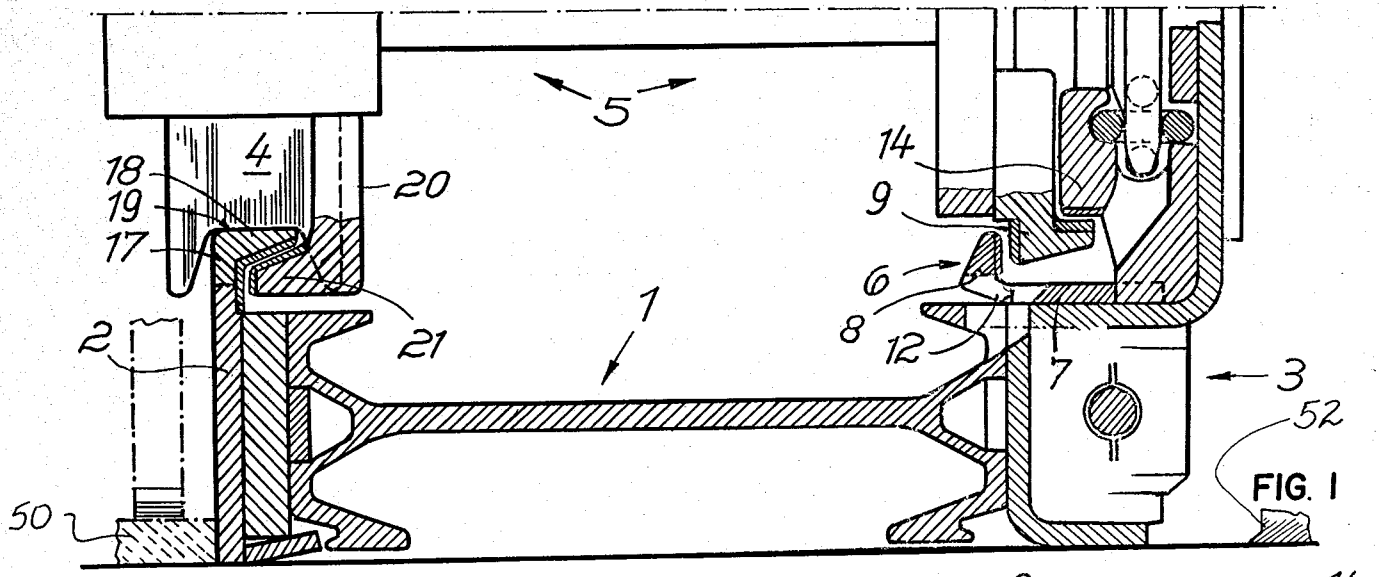
FIG. 1 is a partial vertical sectional view of a conveying trough having an arrangement for the guidance of a gantry-like cutter, constructed in accordance with the present invention.
Figure 3:
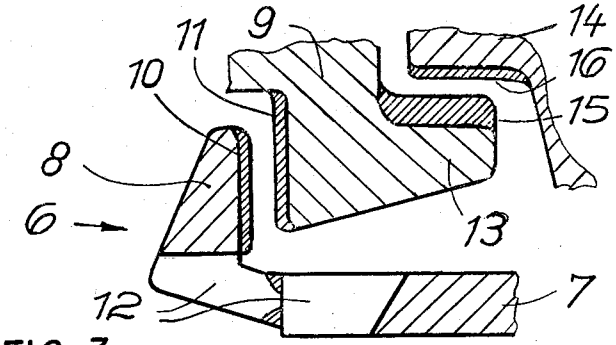
FIG. 3 is a partial sectional view of the device shown in FIG. 1 on the waste side.
Figure 2:
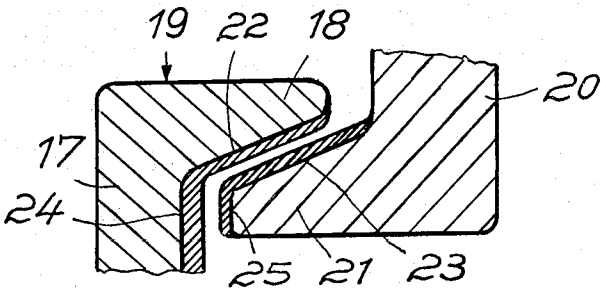
FIG. 2 is a partial sectional view of a portion of the device shown in FIG. 1.
Figure 4:
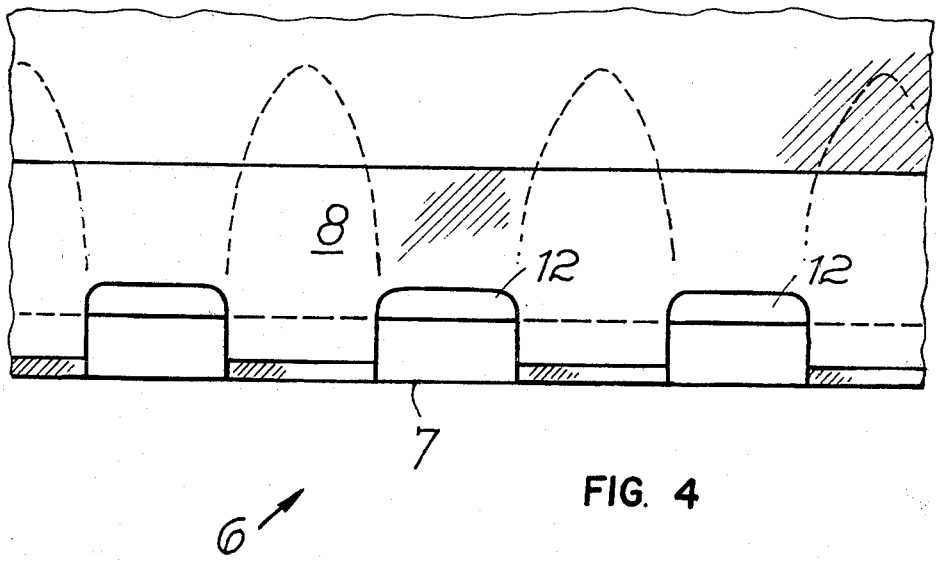
FIG. 4 is a partial side elevational view of the device shown in FIG. 1.
Figure 5:
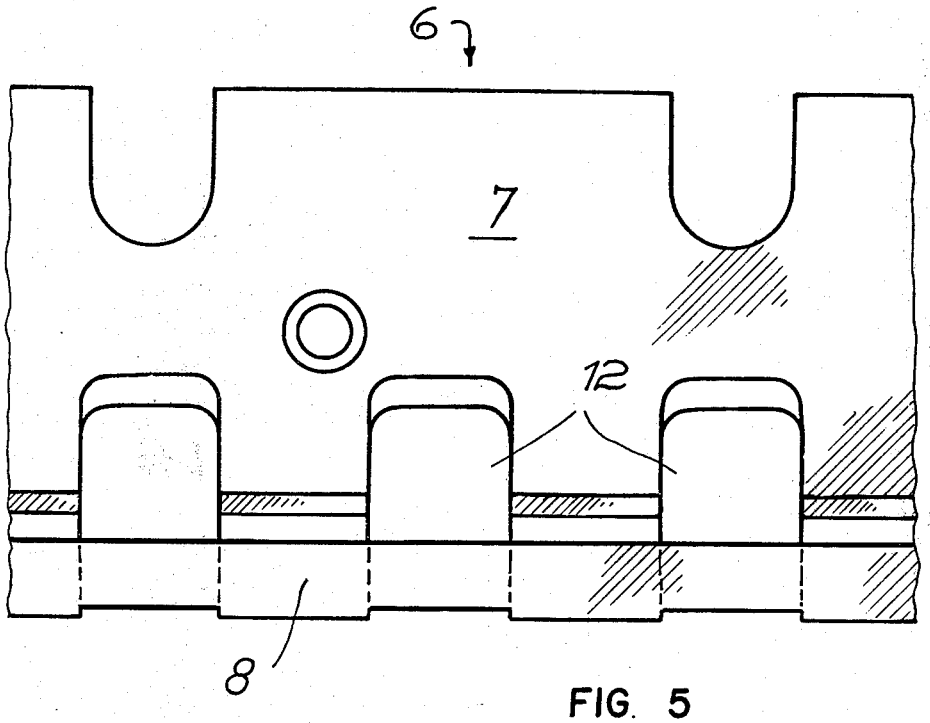
FIG. 5 is a top plan view of the device shown in FIG. 3.

Referring to the drawings in particular, the invention embodied therein, comprises, a conveying trough for use in a coal mining seam which has a coal winning sidewall 50 and a waste sidewall 52 disposed opposite to, and spaced from, the winning sidewall 50. A base frame 3 is adapted to be positioned toward the waste sidewall 52 and a gantry-like cutter 5 is mounted so that it spans a distance between a guideplate 2 adjacent the winning sidewall and a base frame 3 adjacent the waste side.

In accordance with the invention, an angle bar 6 has a first substantially horizontal fixing leg portion secured to the base frame 3 and an upright guide leg portion 8 affixed to the fixing leg portion. A tracking bar 9, carried by the cutter 5, has an edge which is in cooperative engagement with the guide leg portion 8. Guide leg portion 8 and tracking bar 9 are provided with interengageable slide surfaces 10 and 11.

The drawings show a conveying trough 1, with a guide plate 2 secured to the coal face sidewall of the trough, and a base frame 3 secured to the waste sidewall of the trough. Guide plate 2 is associated with a running surface for a track wheel 4 of a cutter 5 which, in a gantry-like manner, bridges the trough. The base frame 3 is equipped for moving the cutter 5 therealong.

In accordance with the invention, base frame 3 supports an angle bar 6 having a fixing leg 7 and an upright extending guide leg 8. Cutter 5 carries a tracking bar 9 which cooperates in horizontal direction with a guide leg 8, for which purpose, both guide leg 8 and tracking bar 9 are provided with vertical slide surfaces or coatings 10, 11. Slide surface 10 of guide leg 8 faces in the waste direction and slide surface 11 of tracking bar 5 faces in the coal face direction. Fixing leg 7 of angle bar 6 is screwed to base frame 3, while guide leg 8 of angle bar 6 is supported on the top of the trough wall.

In the transition zone, between fixing leg 7 and guide leg 8, at predetermined locations spaced from each other, angle bar 6 is provided with apertures 12 for carrying away coal fines. Tracking bar 9 is designed as a hold-down member and is formed, on its side remote from guide leg 8, with a horizontally projecting tracking leg 13 which engages a guide bar 14 from below, which is secured to base frame 3. Slide surfaces or coatings 15 and 16, cooperating with each other, are provided on the top of tracking leg 13 and on the underside of guide bar 14. The sides of the tracking bar 9 and the guide bar 14 facing each other are also designed as slide surfaces so that the horizontal motion of cutter 5 is reduced to the clearance between guide bar 9 and guide leg 8 of angle bar 6.

Guide plate 2 supports a guide rail 17 which is secured, for example, is welded thereto, and is formed with a guide claw 18, with the top of the guide claw forming a running surface 19 for the track wheel 4 of cutter 5, and the underside of the claw being engaged from below by a corresponding claw-like leg 21 of a hold-down member 20 which is carried by cutter 5. Guide claw 18 and claw-like leg 21 have slide surfaces or coatings 22 and 23, which are inclined to the horizontal plane. The vertical zone adjacent the joint between guide plate 2 and guide rail 17, as well as the associated vertical portion of claw-like leg 21, are also designed as slide surfaces or coatings. All of the slide surfaces or coatings 10, 11, 15, 16, 22, 25 are formed by plating with a wear-resistant material.

The conveying trough 1 shown with guide rail 17 on guide plate 2 is intended for use in high workings. If used in thin seams, the guide rails 17 will be omitted and the running surface for track wheel 4 of cutter 5 will be secured to guide plate 2 near the floor, as indicated in dash-dotted lines.

While a specific embodiment of the invention has been shown and described in detail to illustrate the application of the principles of the invention, it will be understood that the invention may be embodied otherwise without departing from such principles.

What is claimed is:

1. A conveying trough for use in a coal mining seam, having a coal mining sidewall and a waste sidewall, opposite to, and spaced from, the winning sidewall, comprising, a guideplate adapted to be secured to the waste sidewall, a base frame adapted to be located adjacent the winning sidewall at a spaced location from the guideplate, a gantry-like cutter having one side with a track wheel having a running surface associated with said guideplate and spanning across the space between said guideplate and said base frame, an angle bar having a first substantially horizontal fixing leg portion secured to said base frame and having an upright guide leg portion affixed to said horizontal portion, a tracking bar carried by said cutter and having an edge in cooperative engagement with said guide leg portion, said tracking bar and said guide leg portion having substantially vertical interengageable slide surfaces.

2. A conveying trough for use in a coal mining seam, as claimed in claim 1, wherein said fixing leg is screwed to said base frame, said guide leg portion being supported above said conveyor, said conveyor comprising a trough having a wall portion disposed directly below said guide leg portion.

3. A conveying trough for use in a coal mining seam, as claimed in claim 1, wherein said angle bar includes an aperture defined between said fixing leg portion and said guide leg portion at spaced locations along its length thereof.

4. A conveying trough for use in a coal mining seam, as claimed in claim 1, wherein said tracking bar comprises a hold-down member having a tracking leg extending away from said fixing leg portion and a guide bar carried by said base frame engaging over said hold-down member.

5. A conveying trough for use in a coal mining seam, as claimed in claim 1, wherein said tracking bar has a hold-down arm portion extending in a direction away from said fixing leg portion, said base frame having a guide member thereon overlying said hold-down arm portion, each of said hold-down arm portion and said tracking bar hold-down portion having interengageable horizontally extending slide surfaces.

6. A conveying trough for use in a coal mining seam, as claimed in claim 1, wherein said cutter includes a tracking bar having one side face engageable with said guide leg slide surface and having a second substantially horizontally extending leg portion, said base frame having a guide member overlying said horizontal leg portion and having a slide surface engageable with a slide surface on said horizontal leg portion.

7. A conveying trough for use in a coal mining seam, as claimed in claim 1, including a guide rail supported on said guide plate having a claw portion extending laterally at the top thereof, said cutter having a hold-down horizontally extending portion extending below said claw member, each of said claw member and said hold-down member being in cooperative interengagement.

8. A conveying trough for use in a coal mining seam, as claimed in claim 7, wherein said claw portion includes an oblique guide surface and a substantially vertical surface, said hold-down member portion including a substantially oblique guide surface engageable with the oblique slide surface of said claw and a substantially vertical slide surface engageable with the vertical slide surface of said claw.

9. A conveying trough for use in a coal mining seam, as claimed in claim 8, wherein the tracking bar includes a horizontal surface with a slide plate, said base frame having a guide member with a horizontal surface with a guide plate overlying said track bar horizontal surface, all of said claw member, said hold-down members, said tracking bar and said guide member having slide surfaces forming interengageable surface portions which are provided with a wear-resistant material.

* * * * *